US006922535B2

(12) United States Patent
Kim

(10) Patent No.: US 6,922,535 B2
(45) Date of Patent: Jul. 26, 2005

(54) METHOD OF DESIGNATING PAPER TYPE AFTER LOADING PAPER IN OUTPUT APPARATUS HAVING MULTI-CASSETTES

(75) Inventor: Hyuck Kim, Gyeonggiado (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/615,028

(22) Filed: Jul. 9, 2003

(65) Prior Publication Data

US 2004/0009003 A1 Jan. 15, 2004

(30) Foreign Application Priority Data

Jul. 9, 2002 (KR) ..... 10-2002-0039732

(51) Int. Cl.[7] ..... G03G 15/00
(52) U.S. Cl. ..... 399/81; 399/45; 399/391
(58) Field of Search ..... 399/45, 81, 393, 399/391

(56) References Cited

U.S. PATENT DOCUMENTS 6,606,466 B2 * 8/2003 Sato ..... 399/81
6,714,747 B2 * 3/2004 Asai ..... 399/45
6,748,183 B2 * 6/2004 Edmonds

FOREIGN PATENT DOCUMENTS

JP 08267851 A * 10/1996 ..... G03G/21/00
JP 10316253 A * 12/1998 ..... G03G/15/00
JP 11349185 A * 12/1999 ..... B41J/13/00

* cited by examiner

*Primary Examiner*—Susan Lee
(74) *Attorney, Agent, or Firm*—Staas & Halsey LLP

(57) ABSTRACT

A method of designating a paper type after loading paper in an output apparatus having one or more cassettes includes determining the one or more cassettes to be designated as certain paper types according to open/closed states of the one or more cassettes and whether the paper is loaded into the one or more cassettes; determining whether a menu for designating a paper type for the one or more cassettes to be designated as certain paper types is displayed on a user interface of the output apparatus; and designating a type of paper loaded into the one or more cassettes to be designated as a paper type in the displayed menu for designating a paper type.

15 Claims, 5 Drawing Sheets

METHOD OF DESIGNATING PAPER TYPE AFTER LOADING PAPER IN OUTPUT APPARATUS HAVING MULTI-CASSETTES

CROSS-REFERENCE TO RELATED APPLICATIONS

This application claims the priority of Korean Patent Application No. 2002-39732, filed on Jul. 9, 2002, in the Korean Intellectual Property Office, the disclosure of which is incorporated herein in its entirety by reference.

BACKGROUND OF THE INVENTION

1. Field of the Invention

The present invention relates to an output apparatus for loading paper using cassettes, and, more particularly, to a method of designating a paper type after loading paper, by which a menu for designating a paper type of the cassettes, into which paper is loaded, is displayed so the user can designate a paper type when a user loads paper into the cassettes, when a higher display priority circumstance does not occur.

2. Description of the Related Art

In general, when an output apparatus, such as a printer, a facsimile, or a composite apparatus, using at least one or more paper cassettes for loading paper, does not have a function of automatically sensing the paper type, a screen that is displayed on an operational panel is checked and input by the user regarding whether a paper type of the cassette that is currently open is changed to a new paper type, or a currently-designated value is used without a change applied. This screen is displayed if an open state of the paper cassette is sensed by a central processing unit (CPU). In this case, if the user wants to change the paper type to a new paper type, the paper type is designated as a new paper type in a menu for designating a paper type.

However, an operation of opening a cassette is performed whenever the user loads paper into the cassette, and can also be performed under other circumstances. Thus, displaying the menu for designating a paper type whenever an open state of the cassette is sensed is inconvenient, and causes the user to perform unnecessary operations. Also, if the menu for designating a paper type is displayed on the operational panel, the menu does not disappear until the user performs a check and input operation. Therefore, the user must perform a series of input operations, which is also inconvenient. Further, if the menu does not disappear until a designation operation is finished, other problems that may occur in a printer are not displayed on the operational panel, and the user cannot handle these situations quickly.

SUMMARY OF THE INVENTION

The present invention provides a method of designating a paper type after loading paper in an output apparatus having multi-cassettes, that is, one or more cassettes, by which a menu for designating a paper type of the cassettes, into which paper is loaded, is displayed such that the user can designate a paper type when a user loads paper into the cassettes, when circumstances of a display priority higher than a paper type designation operation do not occur.

The present invention also provides a method of designating a paper type after loading paper in an output apparatus having one or more cassettes, by which the paper type designation operation is removed, and an initial state of a menu for designating a paper type is displayed, when key data have not been input from a user interface in a predetermined amount of time during a paper type designation operation.

The present invention also provides a method of designating a paper type after loading paper in an output apparatus having one or more cassettes, by which the output apparatus displays higher priority circumstances when they occur during a paper type designation operation, and the paper type designation operation is kept on standby until the circumstances are removed, and then the paper type designation operation resumes.

According to one aspect of the present invention, there is provided a method of designating a paper type after loading paper in an output apparatus having one or more cassettes, the method comprising: determining the one or more cassettes to be designated as certain paper types according to open/closed states of the one or more cassettes and whether paper is loaded into the one or more cassettes; determining whether a menu for designating a paper type for the one or more cassettes to be designated as certain paper types is displayed on a user interface of the output apparatus; and designating a type of paper loaded into the one or more cassettes to be designated as a paper type in the displayed menu for designating a paper type.

According to another aspect of the present invention, there is provided a method of designating a paper type after loading paper in an output apparatus having one or more cassettes, the method comprising: designating display priority on a user interface of the output apparatus for circumstances that may occur in the output apparatus; determining cassettes to be designated as a paper type, in response to the paper having been loaded into the cassettes, which are sequentially sensed for their open/closed states, among the one or more cassettes; displaying a menu for designating a paper type for one cassette selected from the cassettes determined to be designated as a paper type, in response to no higher display priority circumstances occurring; designating a paper type in the displayed menu for designating a paper type; and deleting input information from the menu for designating a paper type, maintaining the paper type at an existing set value, and returning the menu to its initial status in response to key data not being input on the user interface in a predetermined amount of time during the paper type designation.

According to still another aspect of the present invention, there is provided a method of designating a paper type after loading paper in an output apparatus having one or more cassettes, the method comprising: designating display priority on a user interface of the output apparatus for circumstances that may occur in the output apparatus; determining cassettes to be designated as a paper type, in response to the paper having been loaded into the cassettes, which are sequentially sensed for their open/closed states, among the one or more cassettes; displaying a menu for designating a paper type for one cassette selected from the cassettes determined to be designated as a paper type, in response to no higher display priority circumstances occurring; designating a paper type in the displayed menu for designating a paper type; stopping the paper type designation operation in response to the circumstances of a display priority higher than a paper type designation operation occurring, and displaying information on the circumstances; and staying on standby until the circumstances are removed, and then resuming the paper type designation operation.

Additional aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
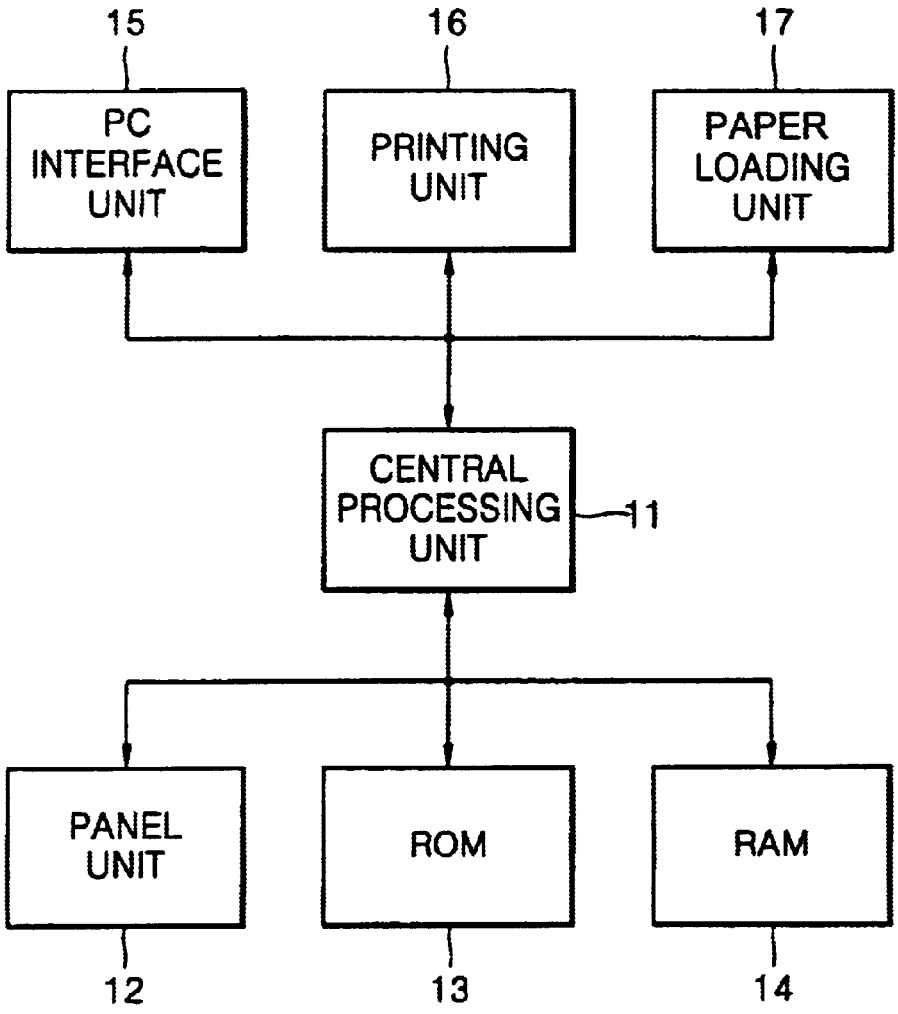
FIG. 1 is a block diagram schematically illustrating the structure of a printer to which the present invention may be applied.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

FIG. 1 is a block diagram schematically illustrating the structure of a printer to which the present invention is applied. Referring to FIG. 1, the printer includes a central processing unit (CPU) 11, a panel unit 12, ROM 13, RAM 14, a PC interface unit 15, a printing unit 16, and a paper loading unit 17.

The operation of the elements of the printer will be briefly described.

The central processing unit (CPU) 11 controls the printer according to a set program. In particular, in the paper loading unit 17, when a user loads paper into cassettes and circumstances of a display priority higher than a paper type designation operation do not occur, the CPU 11 controls the printer to allow the user to designate a paper type by displaying a menu, on a panel unit 12, for designating a paper type of the cassettes into which paper is loaded. Also, when key data has not been input using the panel unit 12 in a predetermined amount of time during the paper type designation operation, the CPU 11 controls the printer to remove the paper type designation operation and to display an initial state of the menu. Also, when a high display priority circumstance occurs during the paper type designation operation, the CPU 11 controls the printer to display the high display priority circumstance and to be kept on standby until the high display priority circumstance is removed, at which point the printer resumes the paper type designation operation. The panel unit 12 includes a plurality of keys so that the user can input various information, and further includes a display window on which the printer status is displayed by a control given by the CPU 11. Various control programs required to perform functions of the printer are stored in the ROM 13. Various data generated by the performance of the control programs, printing data, and printing information received from a computer (not shown) are temporarily stored in the RAM 14. The PC interface unit 15 serves to connect the computer (not shown) to the printer, and printing information and the printing data transmitted from the computer are transferred to the PC interface unit 15. The printing unit 16 receives the printing data from the RAM 14, by a control given by the CPU 11, and performs a printing operation. The paper loading unit 17 includes at least one or more cassettes, and supplies paper when the printing data is output from the printing unit 16.

Figure 2:
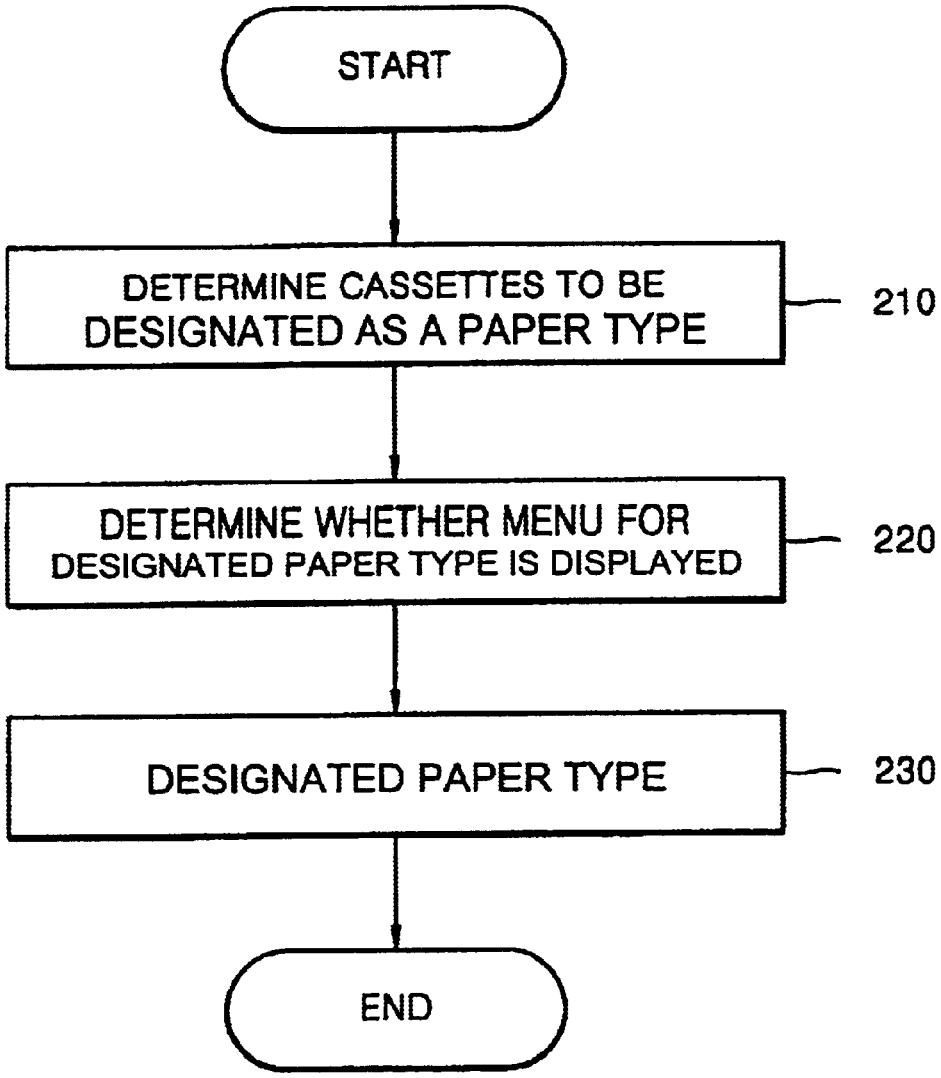
FIG. 2 is a flowchart illustrating a method of designating a paper type after loading paper according to an aspect of the present invention.

FIG. 2 is a flowchart illustrating a method of designating a paper type after loading paper according to an aspect of the present invention. The method of designating a paper type after loading paper according to an aspect of the present invention comprises determining which cassettes to be designated as a paper type, according to the open/closed states of cassettes and depending on whether paper is loaded into the cassettes (210), determining whether a menu for designating a paper type is displayed on a user interface of an OA (output apparatus) instrument, for example, on the display window of the panel unit 12 (220), and designating the type of paper loaded into the cassette in the displayed menu for designating a paper type (230).

Figure 3A:
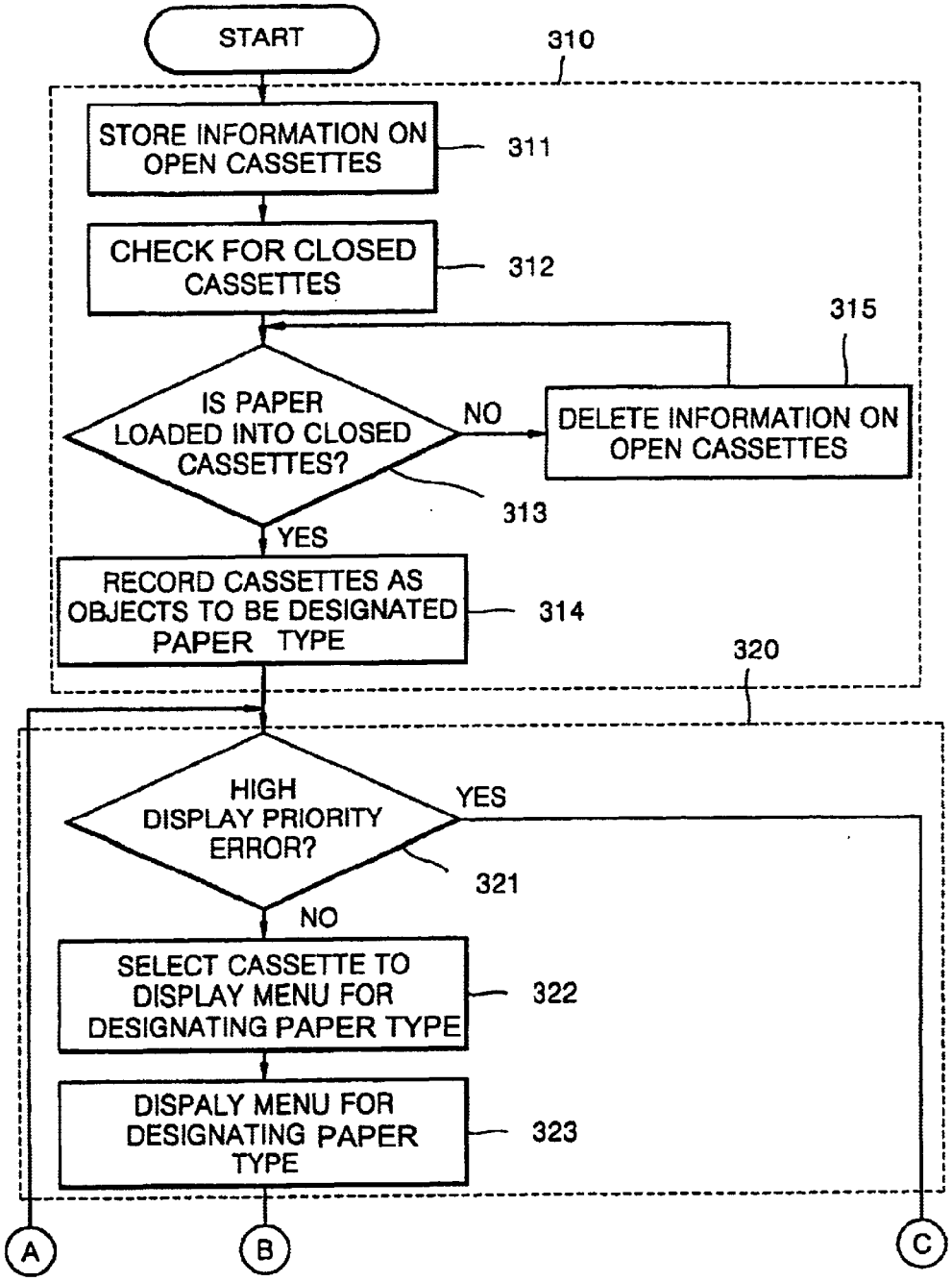
FIGS. 3*a* and 3*b* are detailed flowcharts illustrating an embodiment of the method of designating a paper type after loading paper shown in FIG. 2.
Figure 3B:
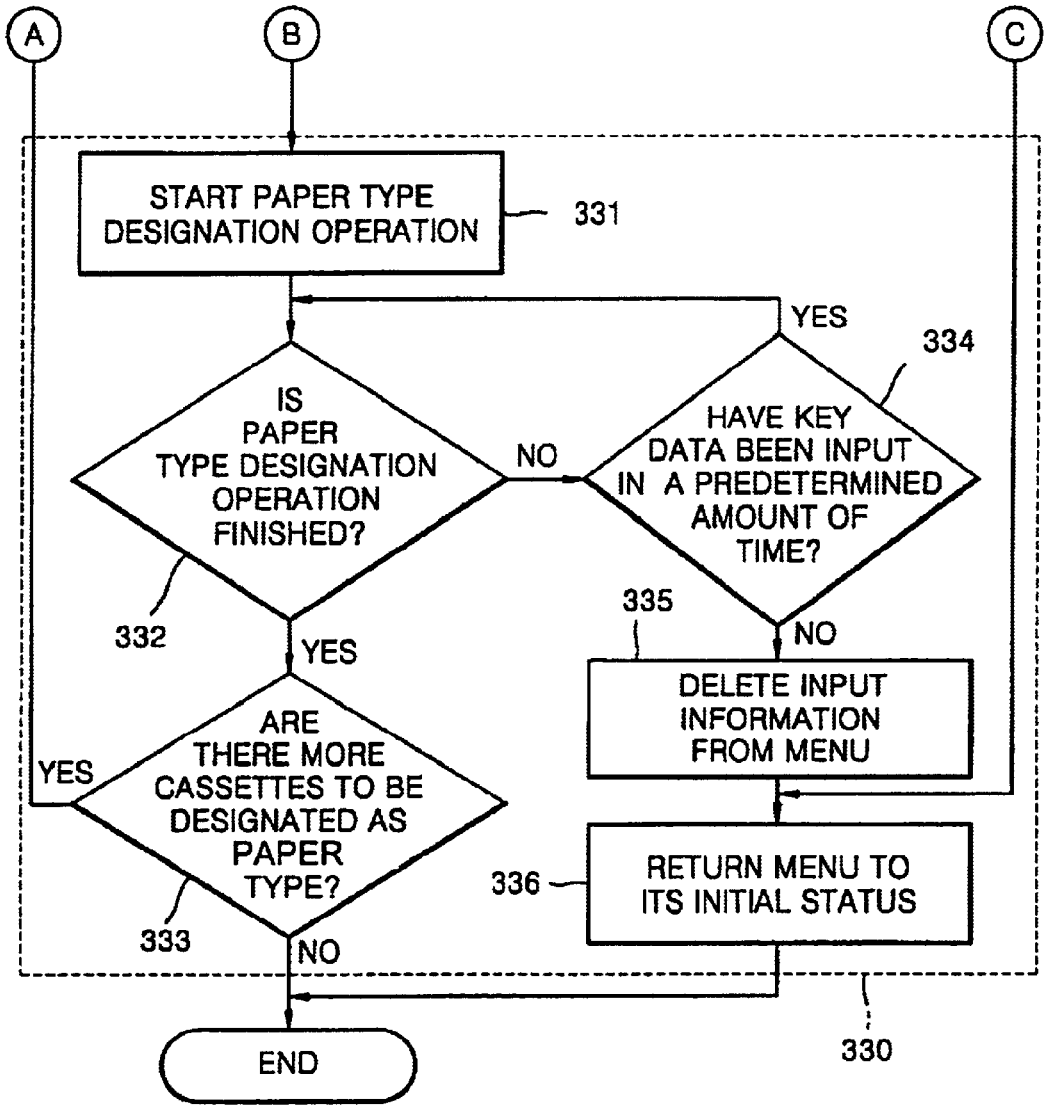

Meanwhile, a detailed flowchart illustrating one embodiment of the method of designating a paper type after loading paper shown in FIG. 2 is shown in FIGS. 3*a* and 3*b*. Reference numerals 310, 320, and 330 correspond to 210, 220, and 230 shown in FIG. 2, respectively.

In FIGS. 3*a* and 3*b*, in 311, open states of cassettes are sensed, and information on the cassettes of which open states are sensed, for example, an identification code value assigned to each cassette, is stored in RAM (14 of FIG. 1). In 312, a check is made to determine whether there are closed cassettes among the cassettes of which open states are sensed. In 313, it is determined whether paper is loaded into the cassettes of which closed states are sensed in 312. In 314, when the paper is loaded into the cassettes, the cassettes are recorded in the RAM as objects to be designated as a paper type. Meanwhile, when the paper is not loaded into the cassettes in 313, in 315, corresponding cassettes are deleted from the information on the open cassettes stored in 311, and the method returns to 313. In steps 311, 312, 313, 314, and 315, one or more cassettes may be designated as certain paper type.

In 321, it is determined whether problematic high display priority circumstances, i.e., errors, currently occur in a printer. In an embodiment of the present invention, display priorities for all problematic circumstances which may occur in the printer, including a paper type designation operation, are set in advance and stored in the RAM. When, as the result of the determination in 321, problematic display priority circumstances higher than the paper type designation operation occur, the method proceeds to 336 so that the panel unit 12 is returned to an initial status of a menu for designating a paper type and displays corresponding status information. Meanwhile, in 322, when, as the result of the determination in 321, problematic display priority circumstances higher than the paper type designation operation do not occur, cassettes to be displayed in the menu for designating a paper type are selected from the cassettes recorded in the RAM in 314. In this case, the cassettes to be displayed in the menu for designating a paper type are selected according to a paper designation priority that is preset for multi-cassettes of the printer. In 323, the menu for designating a paper type of the cassette selected in 322 is displayed in the display window.

In 331, the paper type designation operation starts according to key data input by the user in the displayed menu for designating a paper type. In 332, it is determined whether the paper type designation operation is finished. In 333, when, as the result of determination in 332, the paper type designation operation is finished, it is determined whether there are more cassettes to be designated as a paper type among the cassettes recorded in 314. If there are more cassettes to be designated as a paper type, the method returns to 321, and if there are no more cassettes to be designated as a paper type, the method terminates the above operations. Meanwhile, in 334, when, as the result of determination in 332, the paper type designation operation is not finished, it is determined whether the key data has been input, using the panel unit 12, in a predetermined amount of time, for example, in one minute. If the key data has been input, using the panel unit 12, the method returns to 332. Meanwhile, if the key data has not been input, using the panel unit 12, in 335, the paper type designation information input in 331 is deleted from the menu for designating a paper type, and the paper type is maintained at an existing set value, and the menu is returned to its initial status.

The above-mentioned embodiment will be summarized as follows. First, the cassettes, which are sequentially sensed for their open/closed states, are checked, and when the paper is loaded into the checked cassettes, the cassettes are classified as objects to be designated as a paper type. Next, in a current state, when a display priority of the paper type designation operation is currently the highest, the menu for designating a paper type for the cassette selected from the checked cassettes is displayed. When key data has not been input by the user in the predetermined amount of time during the paper type designation operation, the input data is deleted from the menu for designating a paper type, and the paper type is maintained at the existing set value, and the menu is returned to its initial state.

Figure 4:
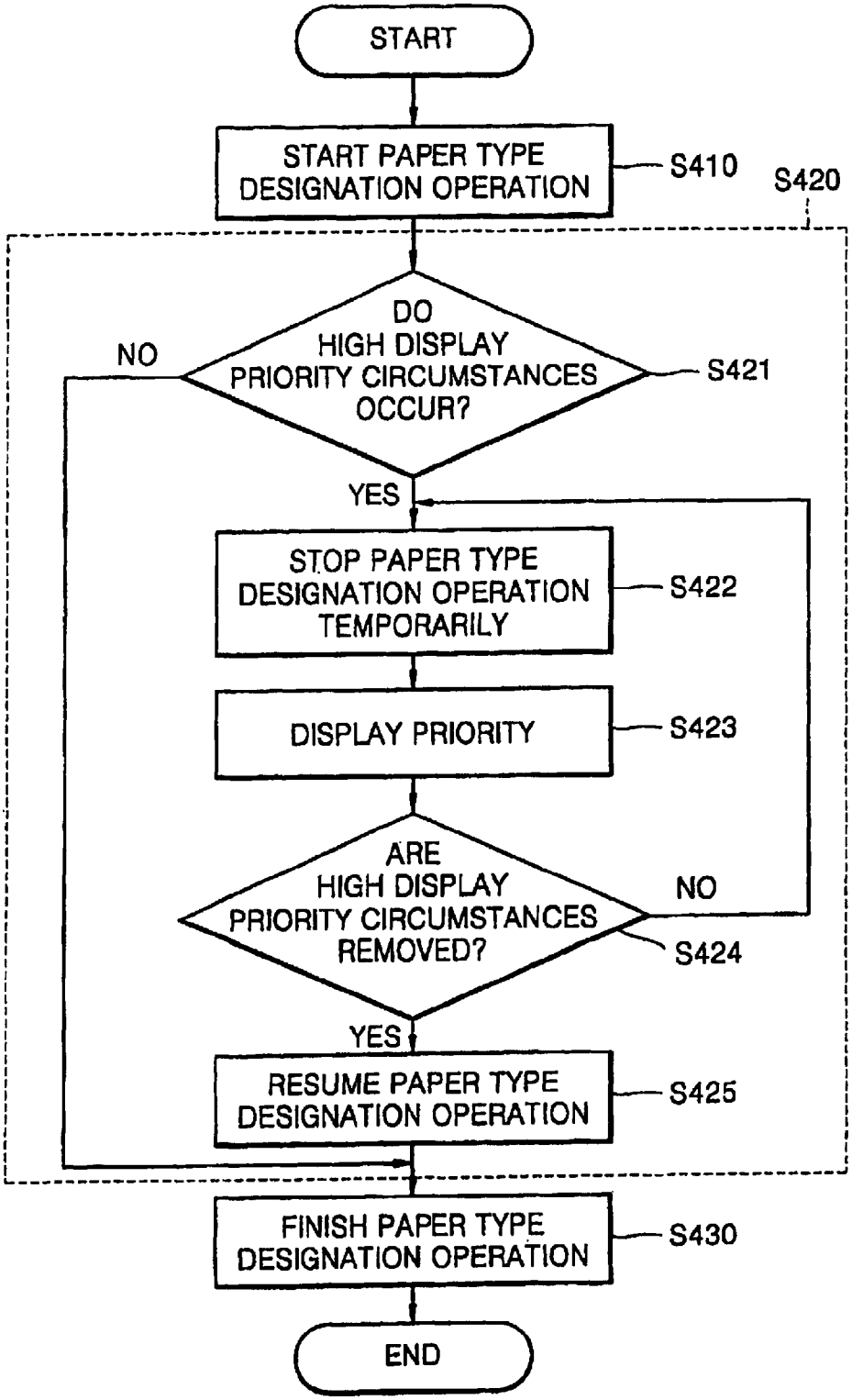
FIG. 4 is a detailed flowchart illustrating another embodiment of the method of designating a paper type after loading paper shown in FIG. 2.

FIG. 4 is a detailed flowchart illustrating another embodiment of the method of designating a paper type after loading paper shown in FIG. 2. The second embodiment comprises starting a paper type designation operation (410), processing problematic high display priority circumstances (420), and finishing the paper type designation operation (430). As in FIGS. 3*a* and 3*b*, 311 through 323, which are performed before the paper type designation operation starts, are applied to FIG. 4, occurring before 410.

In 421, after the paper type designation operation starts in 410, it is determined whether there are problematic display priority circumstances higher than the paper type designation operation. When the problematic display priority circumstances do not occur, in 430, the paper type designation operation is continued until finished. Meanwhile, when the problematic high display priority circumstances do occur, in 422, the paper type designation operation stops temporarily. In 423, status information on the corresponding problematic high display priority circumstances is displayed. In 424, it is determined whether the corresponding problematic high display priority circumstances are removed. When the corresponding problematic high display priority circumstances are removed, in 425, the paper type designation operation resumes. When the corresponding problematic high display priority circumstances are not removed, the method returns to 422, and the status information on the problematic high display priority circumstances is continuously displayed.

The above-mentioned second embodiment will be summarized as follows. First, the cassettes, which are sequentially sensed for their open/closed states, are checked, and when the paper is loaded into the checked cassettes, the cassettes are determined as objects to be designated as a paper type. Next, in a current state, when display priority circumstances higher than the paper type designation operation do not occur, the menu for designating a paper type for the cassettes selected from the checked cassettes is displayed. When the problematic high display priority circumstances occur during the paper type designation operation, the paper type designation operation stops temporarily until the problematic high display priority circumstances are removed. The status information on the problematic high display priority circumstances remains displayed if the problematic circumstances are not removed. When the problematic circumstances are removed, the paper type designation operation resumes.

Meanwhile, the method of designating a paper type after loading paper according to an aspect of the present invention may be implemented by combining the two embodiments discussed above, respectively shown in FIGS. 3 and 4, or other such combinations.

Although a printer having multi-cassettes is exemplified as an output apparatus in the above embodiments, in general, the method of designating a paper type after loading paper according to an aspect of the present invention may be easily applied to a composite apparatus having a printing function, or an OA instrument such as a facsimile.

Meanwhile, the above-mentioned embodiments, as well as other aspects, of the present invention may be implemented as a computer program. The program may be stored in machine readable media and read and executed by a computer. Example of suitable machine readable media include magnetic recording media such as ROMs, floppy disks, or hard disks, optical recording media such as CD ROMs or DVDs, and carrier waves such as transmission via the Internet.

As described above, according to an aspect of the present invention, a CPU senses that paper is loaded into the cassettes. A menu for designating a paper type of the cassettes into which the paper is loaded is displayed, and the user designates the paper type, allowing some operations that the user was previously required to perform to be prevented.

In addition, when the user loads the paper into the cassettes, and problematic high display priority circumstances do not occur, the menu for designating a paper type for the cassettes into which the paper is loaded is displayed, and the user designates the paper type. However, when problematic display priority circumstances higher than a paper type designation operation occur, the problems occurring in an output apparatus are immediately displayed so the user can handle the situation more quickly.

In addition, when key data has not been input by a user using an operational panel in a predetermined amount of time during the paper type designation operation, the paper type designation operation is removed, and an initial status of the menu for designating a paper type is displayed, such that the user can input other key data on the operational panel more conveniently.

In addition, when the problematic high display priority circumstances occur during the paper type designation operation, the problems are displayed, and the printer is kept on standby until the corresponding problematic high display priority circumstances are removed. Then, the paper type designation operation resumes so the user can handle the situation more quickly.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A method of designating a paper type after loading paper in an output apparatus having one or more cassettes, the method comprising:

determining the one or more cassettes to be designated as certain paper types according to open/closed states of the one or more cassettes and whether the paper is loaded into the one or more cassettes;

determining whether a menu for designating a paper type for the one or more cassettes to be designated as certain paper types is displayed on a user interface of the output apparatus; and designating a type of paper loaded into the one or more cassettes to be designated as a paper type in the displayed menu for designating a paper type.

2. The method of claim 1, wherein the determining the one or more cassettes to be designated as certain paper types further comprises:

sensing the open states of the one or more cassettes;

sensing the closed states of cassettes with open states; and identifying as objects to be designated a paper type the cassettes with open states that are sensed to have regained the closed state, and into which the paper is loaded.

3. The method of claim 2, wherein the determining the one or more cassettes to be designated as certain paper types further comprises deleting, from information corresponding to the one or more cassettes with open states, the information corresponding to the cassettes with open states that are not loaded with the paper.

4. The method of claim 1, wherein the determining whether a menu for designating a paper type for the one or more cassettes to be designated as certain paper types is displayed on a user interface of the output apparatus further comprises:

determining whether display priority circumstances higher than a paper type designation operation occur;

displaying the menu for designating a paper type, for the one or more cassettes to be designated as a paper type, in response to the display priority circumstances higher than a paper type designation not occurring; and returning the menu for designating a paper type to its initial status and displaying the initial status of the menu on the user interface in response to the display priority circumstances higher than a paper type designation occurring.

5. The method of claim 1, wherein the designating a type of paper loaded into the one or more cassettes to be designated as a paper type in the displayed menu for designating a paper type further comprises:

displaying the menu for designating a paper type for the one or more cassettes to be designated as a paper type according to the determination of whether the menu is displayed on the user interface;

determining whether a user finishes the paper type designation using the displayed menu for designating a paper type;

determining whether key data has been input by the user in a predetermined amount of time, in response to the user not finishing the paper type designation;

returning to displaying the menu for designating a paper type in response to any remaining cassettes to be designated as a paper type after the user has finished the paper type designation operation; and returning to determining whether the user finishes the paper type designation in response to the key data having been input by the user in the predetermined amount of time.

6. A method of designating a paper type after loading paper in an output apparatus having one or more cassettes, the method comprising:

designating display priority on a user interface of the output apparatus for circumstances that may occur in the output apparatus;

determining cassettes to be designated as a paper type, in response to the paper having been loaded into the cassettes, which are sequentially sensed for their open/closed states, among the one or more cassettes;

displaying a menu for designating a paper type for one cassette, selected from the cassettes determined to be designated as a paper type, in response to no higher display priority circumstances occurring; and designating a paper type in the displayed menu for designating a paper type.

7. The method of claim 6, wherein the selected cassettes to be displayed in the menu for designating a paper type is selected from the cassettes according to a predetermined paper designation priority.

8. The method of claim 6, further comprising deleting input information from the menu for designating a paper type, maintaining the paper type at an existing set value, and returning the menu to its initial status in response to key data not being input on the user interface in a predetermined amount of time during the paper type designation.

9. The method of claim 6, further comprising:

stopping the paper type designation operation in response to the circumstances of a display priority higher than a paper type designation operation occurring, and displaying information on the circumstances; and staying on standby until the circumstances are removed, and then resuming the paper type designation operation.

10. A machine readable storage medium storing a program for performing a method of designating a paper type after loading paper in an output apparatus having one or more cassettes, the method comprising:

determining the one or more cassettes to be designated as certain paper types according to open/closed states of the one or more cassettes and whether the paper is loaded into the one or more cassettes;

determining whether a menu for designating a paper type for the one or more cassettes to be designated as certain paper types is displayed on a user interface of the output apparatus; and designating a type of paper loaded into the one or more cassettes to be designated as a paper type in the displayed menu for designating a paper type.

11. A machine readable storage medium storing a program for performing a method of designating a paper type after loading paper in an output apparatus having one or more cassettes, the method comprising:

designating display priority on a user interface of the output apparatus for circumstances that may occur in the output apparatus;

determining cassettes to be designated as a paper type, in response to the paper having been loaded into the cassettes, which are sequentially sensed for their open/closed states, among the one or more cassettes;

displaying a menu for designating a paper type for one cassette, selected from the cassettes determined to be designated as a paper type, in response to no higher display priority circumstances occurring; and designating a paper type in the displayed menu for designating a paper type.

12. The machine readable storage medium of claim 11, wherein the method further comprises deleting input information from the menu for designating a paper type, maintaining the paper type at an existing set value, and returning the menu to its initial status in response to key data not being input on the user interface in a predetermined amount of time during the paper type designation.

13. The machine readable storage medium of claim 11, wherein the method further comprises:

stopping the paper type designation operation in response to the circumstances of a display priority higher than a paper type designation operation occurring, and displaying information on the circumstances; and staying on standby until the circumstances are removed, and then resuming the paper type designation operation.

14. An image producing apparatus having one or more cassettes into which paper is loaded, comprising:

a control unit designating a paper type after loading paper in the image producing apparatus, said designating comprising:

determining the one or more cassettes to be designated as certain paper types according to open/closed states of the one or more cassettes and whether paper is loaded into the one or more cassettes;

determining whether a menu for designating a paper type for the one or more cassettes to be designated as certain paper types is displayed on a user interface of the output apparatus; and designating a type of paper loaded into the one or more cassettes to be designated as a paper type in the displayed menu for designating a paper type.

15. An image producing apparatus having one or more cassettes into which paper is loaded, comprising:

a control unit designating a paper type after loading paper in the image producing apparatus, said designating comprising:

designating display priority on a user interface of an output apparatus for circumstances that may occur in the output apparatus;

determining cassettes to be designated as a paper type, in response to the paper having been loaded into the cassettes, which are sequentially sensed for their open/closed states, among the one or more cassettes;

displaying a menu for designating a paper type for one cassette, selected from the cassettes determined to be designated as a paper type, in response to no higher display priority circumstances occurring; and designating a paper type in the displayed menu for designating a paper type.

* * * * *

UNITED STATES PATENT AND TRADEMARK OFFICE

CERTIFICATE OF CORRECTION

PATENT NO. : 6,922,535 B2
DATED : July 26, 2005
INVENTOR(S) : Hyuck Kim

It is certified that error appears in the above-identified patent and that said Letters Patent is hereby corrected as shown below:

Title page,
Item [75], Inventor, change "Gyeonggiado" to -- Gyeonggi-do --.

Signed and Sealed this

Fourth Day of April, 2006

JON W. DUDAS
*Director of the United States Patent and Trademark Office*